US007032333B2

(12) United States Patent
Friberg et al.

(10) Patent No.: US 7,032,333 B2
(45) Date of Patent: Apr. 25, 2006

(54) SNOWTHROWER CHUTE AND DEFLECTOR CONTROL

(75) Inventors: Nathan J. Friberg, Bloomington, MN (US); Donald M. White, III, Chanhassen, MN (US)

(73) Assignee: The Toro Company, Bloomington, MN (US)

( * ) Notice: Subject to any disclaimer, the term of this patent is extended or adjusted under 35 U.S.C. 154(b) by 0 days.

(21) Appl. No.: 10/464,434

(22) Filed: Jun. 18, 2003

(65) Prior Publication Data

US 2004/0255493 A1 Dec. 23, 2004

(51) Int. Cl.
*E01H 5/09* (2006.01)

(52) U.S. Cl. ..... 37/260; 237/262

(58) Field of Classification Search ..... 37/244, 37/246, 248, 249, 254, 260, 262; 74/145, 74/473.33, 473.34

See application file for complete search history.

(56) References Cited

U.S. PATENT DOCUMENTS

| | | | | | |
|---|---|---|---|---|---|
| 2,200,623 | A | * | 5/1940 | James | 37/252 |
| 2,642,680 | A | | 6/1953 | Curtis et al. | |
| 3,075,813 | A | * | 1/1963 | Vohl | 406/158 |
| 3,466,767 | A | | 9/1969 | Rubin | |
| 3,468,041 | A | | 9/1969 | Mattison et al. | |
| 3,580,351 | A | * | 5/1971 | Mollen | 180/53.7 |
| 3,760,517 | A | * | 9/1973 | Blaauw | 37/260 |
| 3,828,450 | A | * | 8/1974 | Boeck | 37/260 |
| 3,867,773 | A | * | 2/1975 | Gunderson | 37/260 |
| 3,879,866 | A | | 4/1975 | Gunderson | |
| 4,011,668 | A | | 3/1977 | Gunderson | |
| 4,205,468 | A | * | 6/1980 | Greider | 37/260 |
| 4,549,365 | A | * | 10/1985 | Johnson | 37/251 |
| 4,694,594 | A | * | 9/1987 | Thorud et al. | 37/244 |
| 4,862,607 | A | * | 9/1989 | Wacker | 37/260 |
| 5,315,771 | A | * | 5/1994 | White et al. | 37/260 |
| 5,438,770 | A | * | 8/1995 | Miller | 37/227 |
| 5,444,927 | A | * | 8/1995 | Sosenko | 37/260 |
| 6,058,629 | A | * | 5/2000 | Peterson et al. | 37/261 |
| 6,327,798 | B1 | | 12/2001 | Sakai et al. | |
| 6,499,238 | B1 | | 12/2002 | Kluck et al. | |

(Continued)

FOREIGN PATENT DOCUMENTS

JP 2-190505 7/1990

OTHER PUBLICATIONS

Sunbeam Snow Champ Power brochure, 1978, last page.

(Continued)

*Primary Examiner*—Thomas A Beach
(74) *Attorney, Agent, or Firm*—James W. Miller

(57) ABSTRACT

A single joystick type control handle controls the chute and deflector of a snowthrower. The control handle can be moved laterally from side to side and a second linkage including a gear connection laterally rotates the chute from side to side in the same direction, i.e. movement of the control handle to the left rotates the chute to the left and vise versa. The gear connection has a mechanical advantage that increases the amount of the angular rotation of the chute, i.e. the chute rotates further than the angular movement of the control handle. The control handle can also be moved longitudinally from fore to aft and a second linkage comprising a flexible cable pivots the deflector up and down on the chute in the same direction, i.e. moving the control handle forward pivots the deflector down and vise versa. A locking mechanism is provided to hold the chute and the deflector in their adjusted positions.

36 Claims, 9 Drawing Sheets

U.S. PATENT DOCUMENTS 6,622,464 B1 9/2003 Goman

OTHER PUBLICATIONS

Yamaha YS-524T Owner's Manual, 1983, pp. 12 & 25.
Honda HS55/HS70 Owner's Manual, 1984, p. 14.
Yamaha Ricky brochure, 1989, showing console mounted joystick for electrically controlling chute rotation.
Honda brochure, 2001, showing Power Chute joystick control for electrically controlling chute rotation and deflector angle.

* cited by examiner

SNOWTHROWER CHUTE AND DEFLECTOR CONTROL

TECHNICAL FIELD

This invention relates to snowthrowers having a rotatable chute for adjusting the direction of a snow stream thrown by the snowthrower and having a pivotal deflector on the top of the chute for adjusting the trajectory of the snow stream. More particularly, this invention relates to a control for conveniently manipulating the chute and the deflector to allow precise placement of the snow stream.

BACKGROUND OF THE INVENTION

Snowthrowers are known having upright chutes through which a snow stream is thrown. The chute can be rotated on the snowthrower from one side to the other to direct where the snow stream is deposited laterally relative to the snowthrower. Typically, this is done by a manually operated crank which turns the chute through a worm gear engaging a toothed ring on the bottom of the chute. Many turns of the crank are required to turn the chute completely from one side to the other. This can be tiring and inconvenient to do particularly where one must redirect the snow stream frequently as when going back and forth on a driveway or the like.

Most snowthrowers having rotatable chutes also usually have a pivotal deflector on the top of the chute. The angle of inclination of the deflector on the chute controls the trajectory of the snow stream. The deflector is usually formed with an integral handle. The user can grab the handle to manually move the deflector to an adjusted position. The friction between the deflector and the chute is strong enough to retain the deflector in an adjusted position.

The user must be able to reach the handle on the deflector in order to adjust the deflector. This usually requires the user to come around from the usual operating position behind the handle of the snowthrower to one side of the snowthrower in order to be adjacent to the deflector to be able to reach the handle on the deflector. Again, the need to walk around from behind the handle every time one wishes to adjust the deflector is inconvenient and annoying to many users. As a result, the deflector may not be adjusted by the user even though it would be desirable to raise or lower the trajectory of the snow stream.

Some snowthrowers have been proposed which use a single joystick type control handle to control both the chute and the deflector. This control handle can be operated while the user is standing behind the handle assembly of the snowthrower. This is somewhat more convenient than when separate controls are provided for the chute and the deflector. It is also more convenient in the sense that the deflector can be adjusted without having to leave the usual operator's position behind the handle.

However, in known joystick designs of this type, the joystick operates the chute and deflector through separate electric motors. One motor is used to operate the chute and the other motor is used to operate the deflector. Obviously, this requires that the snowthrower carry two separate electric motors, thereby raising the cost to manufacture and sell the snowthrower. In addition, since snowthrowers are often operated and stored in extremely cold conditions, electric motors are not as durable as is desired. Japanese Patent Application 2-190505 discloses such a joystick control operating two electric motors for rotating the chute and pivoting the deflector.

A simpler,less expensive and durable control for quickly and easily operating the chute and deflector on a snowthrower is needed in the snowthrower art.

SUMMARY OF THE INVENTION

One aspect of this invention relates to a snowthrower of the type having a chute rotatable about a substantially vertical axis for directing a snow stream laterally with respect to the snowthrower. A deflector is carried on the chute with the deflector being pivotal about a substantially horizontal axis for adjusting the trajectory of the snow stream. A control is provided on the snowthrower for operating the chute and the deflector. The improvement of this invention relates to the control which comprises a single control handle carried on the snowthrower for motion along first and second axes. A first mechanical linkage couples the chute to the control handle such that movement of the control handle along the first axis rotates the chute about the substantially vertical axis. A second mechanical linkage couples the deflector to the control handle such that movement of the control handle along the second axis pivots the deflector on the chute about the substantially horizontal axis.

Another aspect of this invention relates to a snowthrower as described above. In this aspect, a single control handle is carried on the snowthrower for lateral motion and longitudinal motion. A rotatable arm has an axis and is linked to the control handle. The arm is free to rotate on the snowthrower about the axis of the arm as the control handle is moved laterally. The arm is mechanically linked to a drive gear operatively connected to the chute such that rotation of the arm by lateral motion of the control handle rotates the drive gear to rotate the chute about the substantially vertical axis. A flexible cable connects the control handle and the deflector such that longitudinal motion of the control handle retracts the cable to pull on the deflector to pivot the deflector about the substantially horizontal axis.

Yet another aspect of this invention relates to means for mechanically rotating the chute about the substantially vertical axis and for mechanically pivoting the deflector about the substantially horizontal axis using a single joystick type control handle.

An additional aspect of this invention relates to a snowthrower of the type having a chute rotatable about a substantially vertical axis for directing a snow stream. A deflector is carried on the chute for pivoting about a substantially horizontal axis for adjusting the trajectory of the snow stream. A control is provided on the snowthrower for operating the chute and the deflector. The control comprises a control handle carried on the snowthrower. A first mechanical linkage couples the control handle to at least a first component from a group of components comprising the chute and the deflector such that movement of the control handle along a first axis mechanically moves the first component. A positive latch maintains the first component in an adjusted position during operation of the snowthrower.

BRIEF DESCRIPTION OF THE DRAWINGS

This invention will be described hereafter in the Detailed Description, taken in conjunction with the following drawings, in which like reference numerals refer to like elements or parts throughout.

FIG. 3 is a top plan view of the snowthrower chute and deflector control shown in FIG. 1, particularly illustrating use of the control to adjust the direction of the chute relative to the snowthrower to adjust the side-to-side direction of the snow stream being thrown by the chute;

DETAILED DESCRIPTION

One embodiment of a snowthrower chute and deflector control according to this invention is illustrated generally as 2 in FIGS. 1–9. A typical snowthrower of the type with which control 2 may be used is illustrated generally as 4. Snowthrower 4 may be any snowthrower incorporating suitable snow removal components for gathering snow from the ground and for throwing the gathered snow in a snow stream away from the snowthrower. Thus, snowthrower 4 may be either a single stage snowthrower having a single snow gathering and throwing impeller or a two stage snowthrower having an auger for gathering snow as well as an impeller for throwing the snow gathered by the auger.

Figure 7:
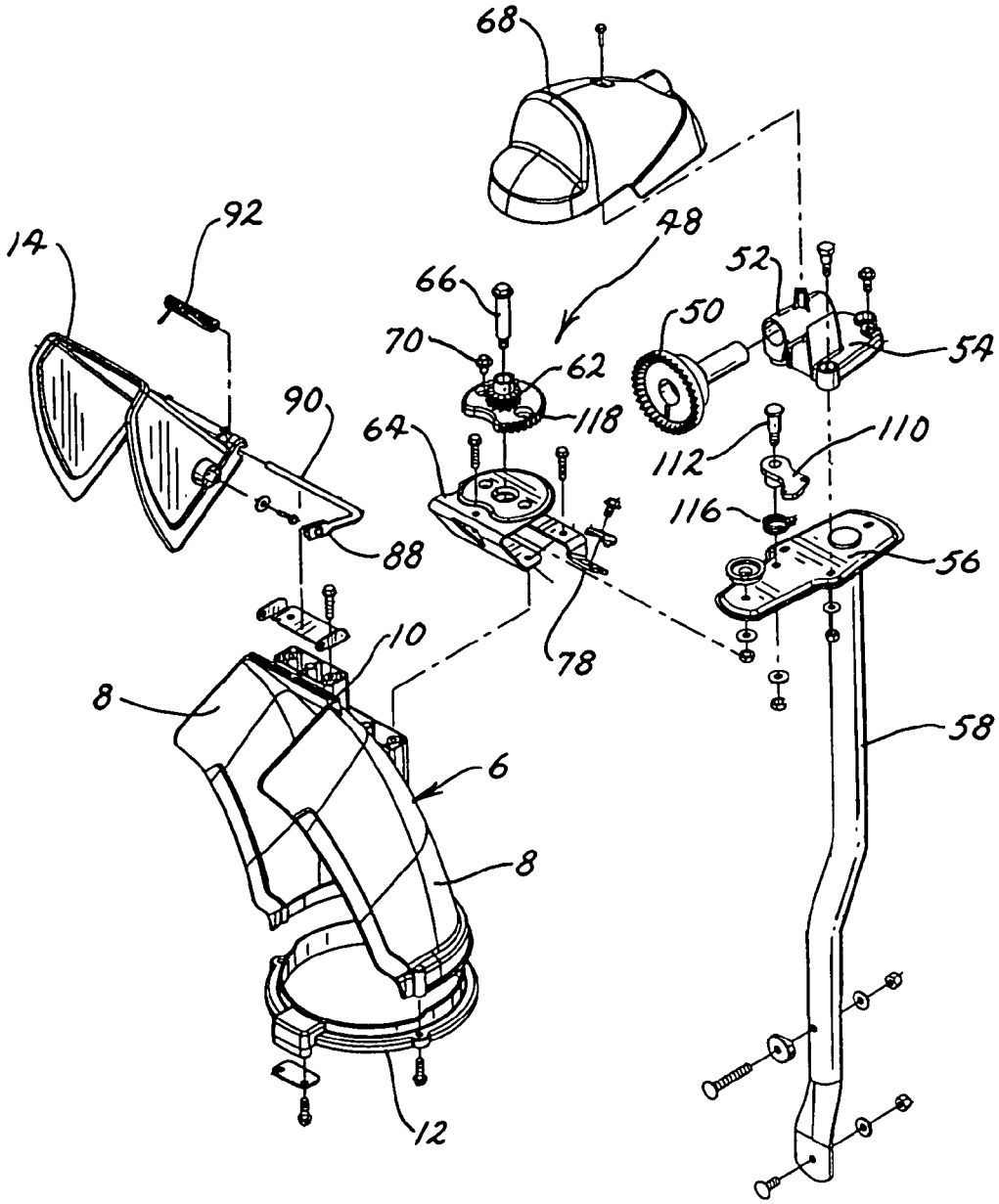
FIG. 7 is an exploded perspective view of other portions of the snowthrower chute and deflector control shown in FIG. 1, particularly illustrating the structure for adjusting the direction of the chute relative to the snowthrower.

Snowthrower 4 is also of the type having a generally upright or vertically extending chute 6 through which the snow stream is thrown. As shown in FIG. 7, chute 6 is generally U-shaped having spaced, parallel side walls 8 connected together by a back wall 10. The bottom of chute 6 is fixed to a ring 12 that serves to rotatably mount chute 6 on snowthrower 4 for rotation about a generally vertical axis y. See FIG. 8. Rotation of chute 6 about vertical axis y adjusts the direction of the snow stream relative to snowthrower 4 as will be described more fully hereafter.

Figure 8:
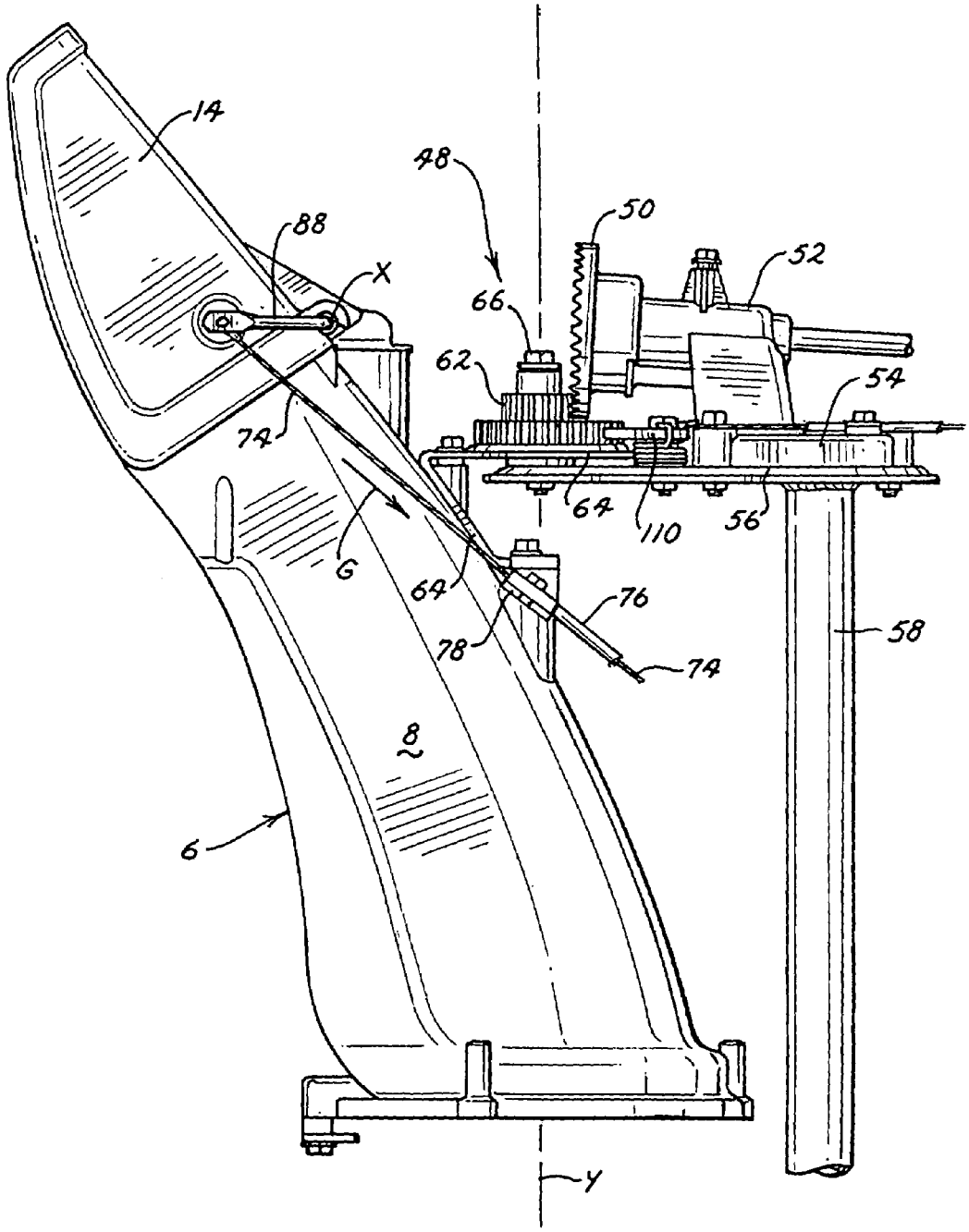
FIG. 8 is a side elevational view of the chute adjusting structure shown in FIG. 7.
Figure 9:
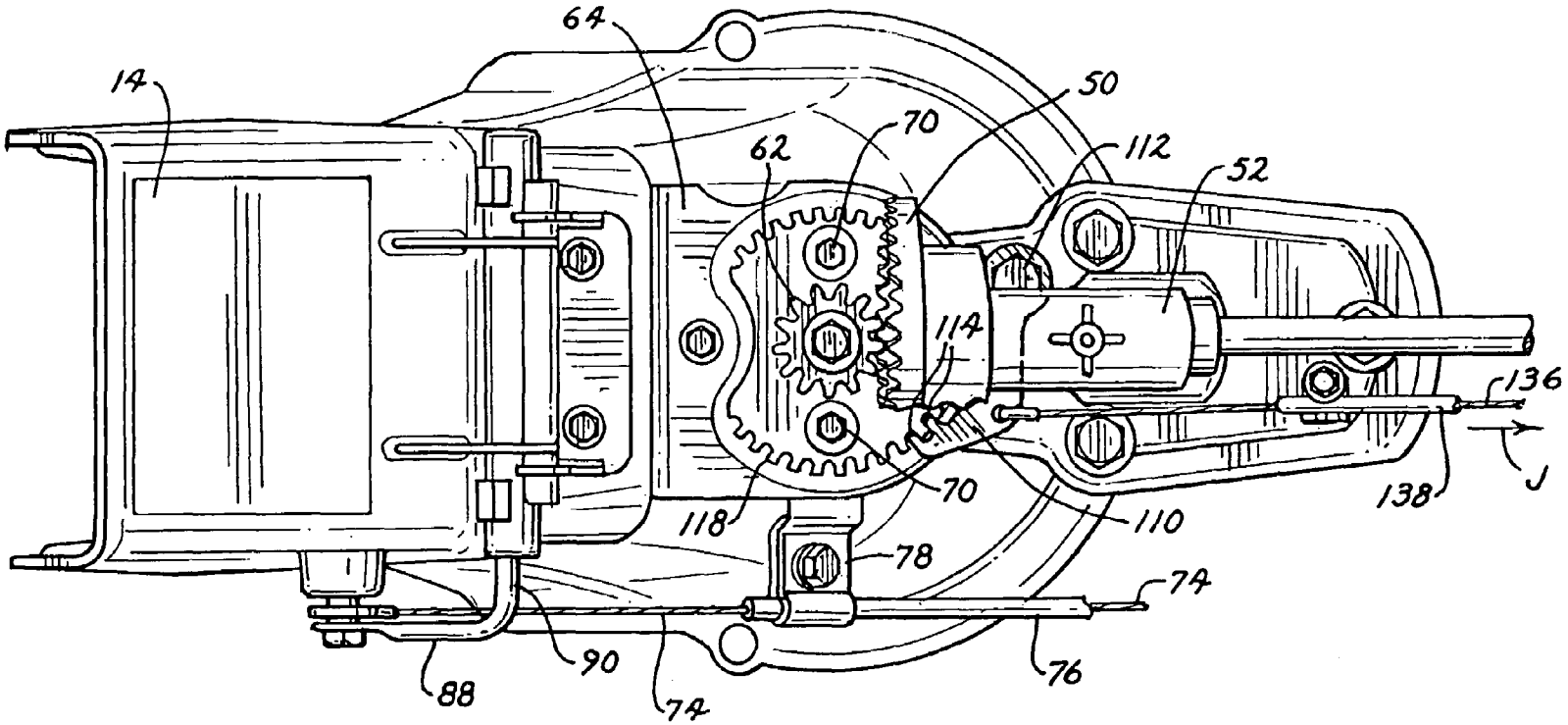

The top of chute 6 carries a pivotal deflector 14. Deflector 14 is also U-shaped but is slightly larger than the top of chute 6 such that the top of chute 6 nests within the bottom of deflector 14 as shown in FIG. 8. Deflector 14 pivots on the top of chute 6 about a horizontal axis x. Pivoting of deflector 14 about horizontal axis x adjusts the trajectory of the snow stream being thrown by chute 6 as will also be described more fully hereafter.

Rotatable chute 6 and pivotal deflector 14 as disclosed herein are of the type commonly found on snowthrowers. There is nothing novel about chute 6 and deflector 14 per se. Rather, this invention relates to a control 2 for operating both chute 6 and deflector 14. In other words, this invention relates to a control 2 for rotating chute 6 about vertical axis y and for pivoting deflector 14 about horizontal axis x.

Control 2 of this invention comprises a single control handle 18 for operating both chute 6 and deflector 14. Control handle 18 is in the nature of a joystick having pivotal motion along two perpendicular axes a and b shown in FIG. 5. Control handle 18 is carried on a handle assembly 17 of snowthrower 4 to be convenient to a user who is standing behind handle assembly 17. The user never has to leave the usual operational position behind handle assembly 17 in order to grab control handle 18 to adjust either chute 6 or deflector 14.

As shown in FIG. 3, control handle 18 can be pivoted laterally from side to side on snowthrower 4 along lateral axis a as indicated by the arrows A and B. The arrow A depicts lateral pivoting of control handle 18 to the right side from a neutral position of control handle 18. The arrow B depicts lateral pivoting of control handle 18 to the left side from the neutral position of control handle 18. Lateral pivoting of control handle 18 produces side to side rotation of chute 6 in the same direction. Namely, pivoting control handle 18 to the right will rotate chute 6 to the right and pivoting control handle 18 to the left will rotate chute 6 to the left.

Figure 1:
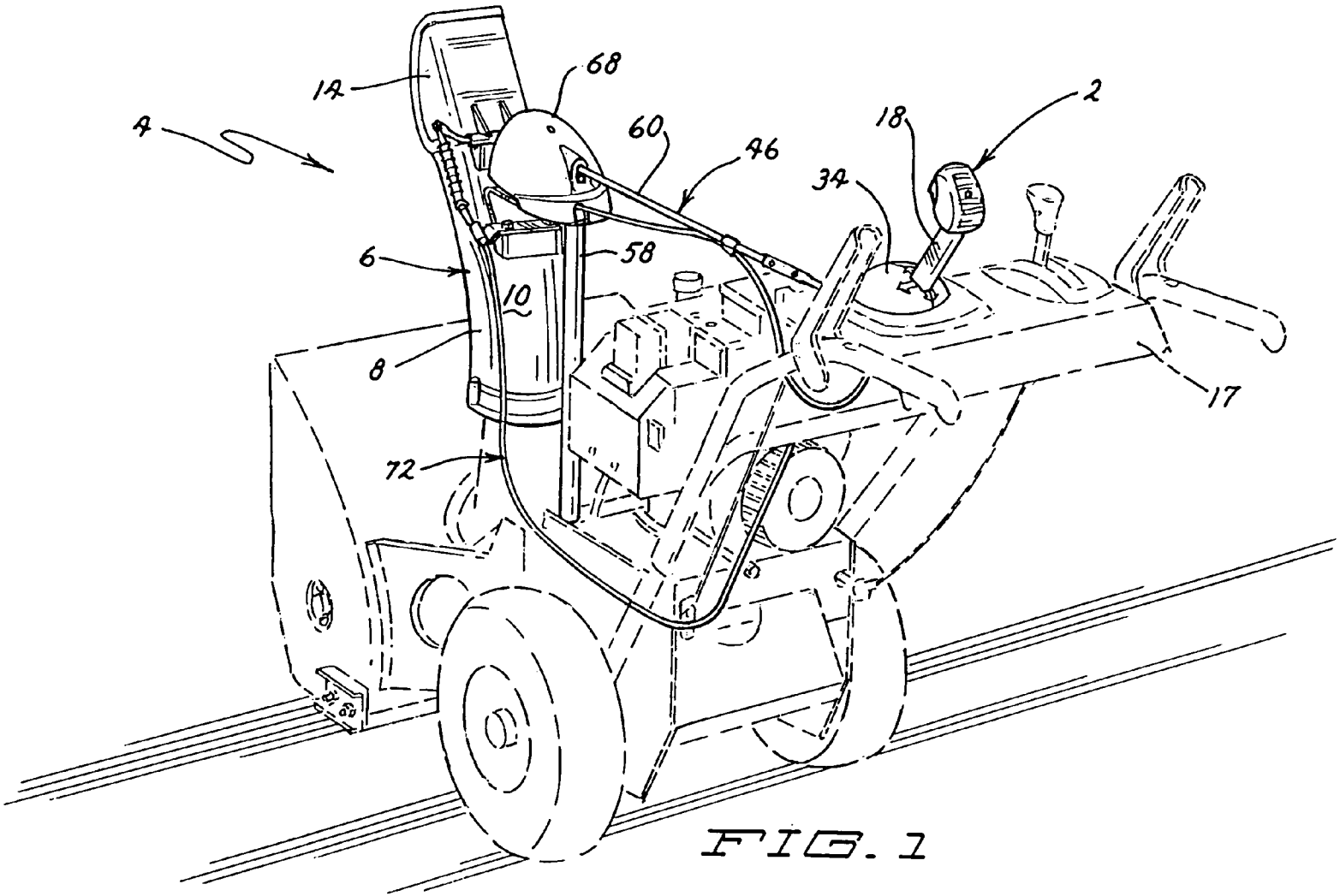
FIG. 1 is a perspective view of a snowthrower chute and deflector control according to this invention.
Figure 2:
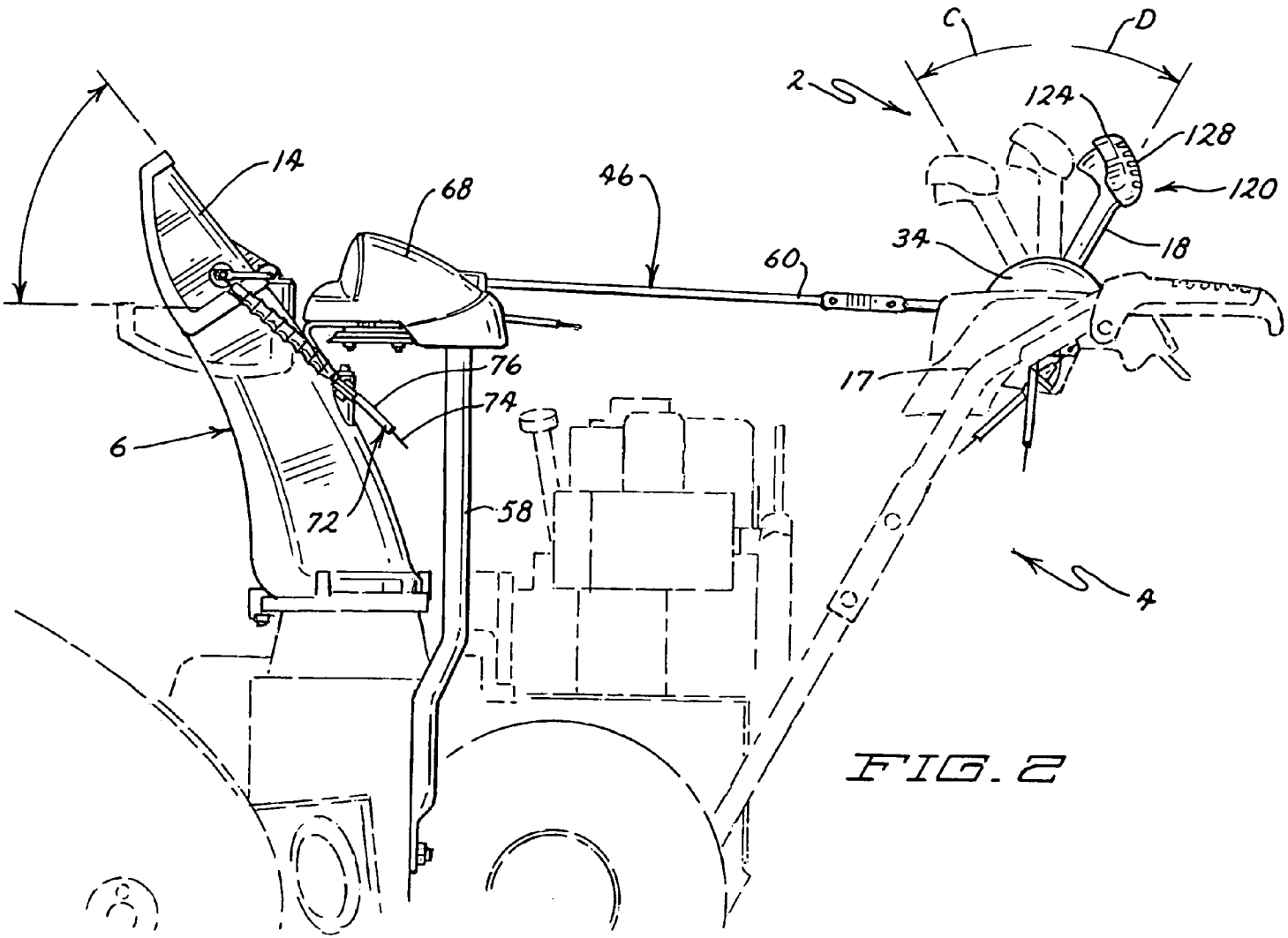
FIG. 2 is a side elevational view of the snowthrower chute and deflector control shown in FIG. 1, particularly illustrating use of the control to adjust the angle of inclination of the deflector to adjust the trajectory of the snow stream being thrown by the chute.

Referring now to FIG. 2, control handle 18 also pivots longitudinally from fore to aft along longitudinal axis b as indicated by the arrows C and D. When control handle 18 is pivoted forwardly as represented by the arrow C, control handle 18 produces a downward pivoting of deflector 14 to lower the trajectory of the snow stream. Conversely, when control handle 18 is pivoted rearwardly as represented by the arrow D, control handle 18 produces an upward pivoting of deflector 14 to raise the trajectory of the snow stream. The solid line position of control handle 18 in FIG. 2 is the position in which control handle 18 has been pivoted rearwardly to its fullest extent thereby raising deflector 14 by a maximum amount to produce the highest trajectory of the snow stream.

Figure 4:
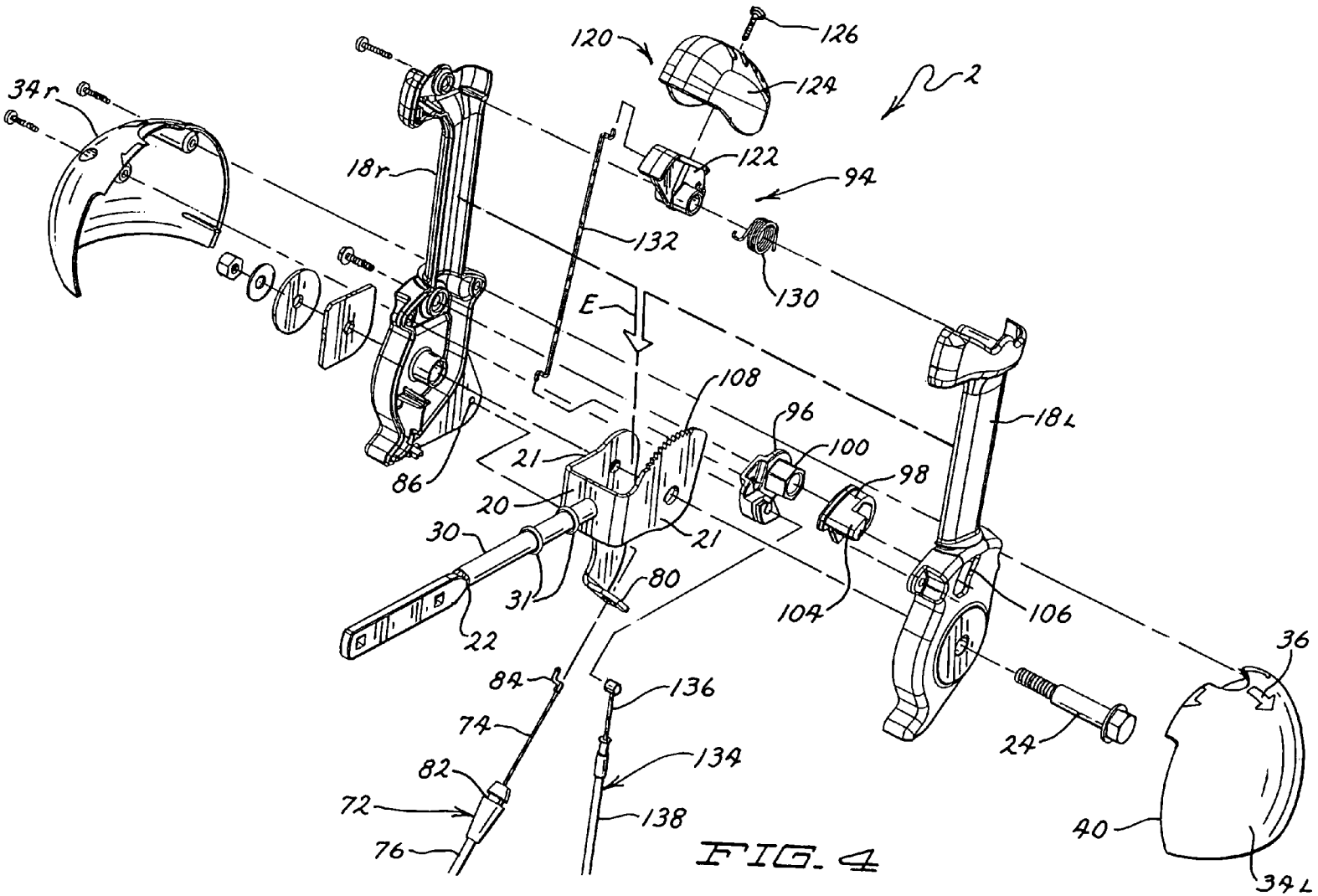
FIG. 4 is an exploded perspective view of a portion of the snowthrower chute and deflector control shown in FIG. 1, particularly illustrating a single control handle for moving both the chute and the deflector.

Referring to FIG. 4, control handle 18 is formed from two handle halves **18*r* and 18*l* that are screwed or bolted together. Various components for locking control handle 18, as will be described later, are captured between handle halves 18*r* and 18*l* before handle halves 18*r* and 18*l* are screwed together. A U-shaped yoke 20 is provided having a forwardly extending arm 22 carried thereon. Once handle halves 18*r* and 18*l* are assembled together to form control handle 18, control handle 18 is received between the spaced apart legs 21 of yoke 22. This is indicated in FIG. 4 by the arrow E indicating placement of control handle 18 between legs 21 of yoke 20**.

Control handle 18 is retained and captured between legs 21 of yoke 20 so that lateral pivoting of control handle 18 produces lateral pivoting of yoke 20 as well. Thus, whenever control handle 18 pivots laterally to either side as indicated by the arrows A and B in FIG. 3, control handle 18 pivots yoke 20 with it in the same direction. However, control handle 18 is also pivotally carried on a transverse pivot pin 24 that passes through yoke 20 such that control handle 18 can longitudinally pivot fore and aft in the direction of arrows C and D in FIG. 2 without causing any similar longitudinal pivoting of yoke 20. In other words, whenever control handle 18 pivots longitudinally as indicated by the arrows C and D in FIG. 2, control handle 18 does so independently of yoke 20 with yoke 20 remaining stationary relative to control handle 18.

Figure 5:
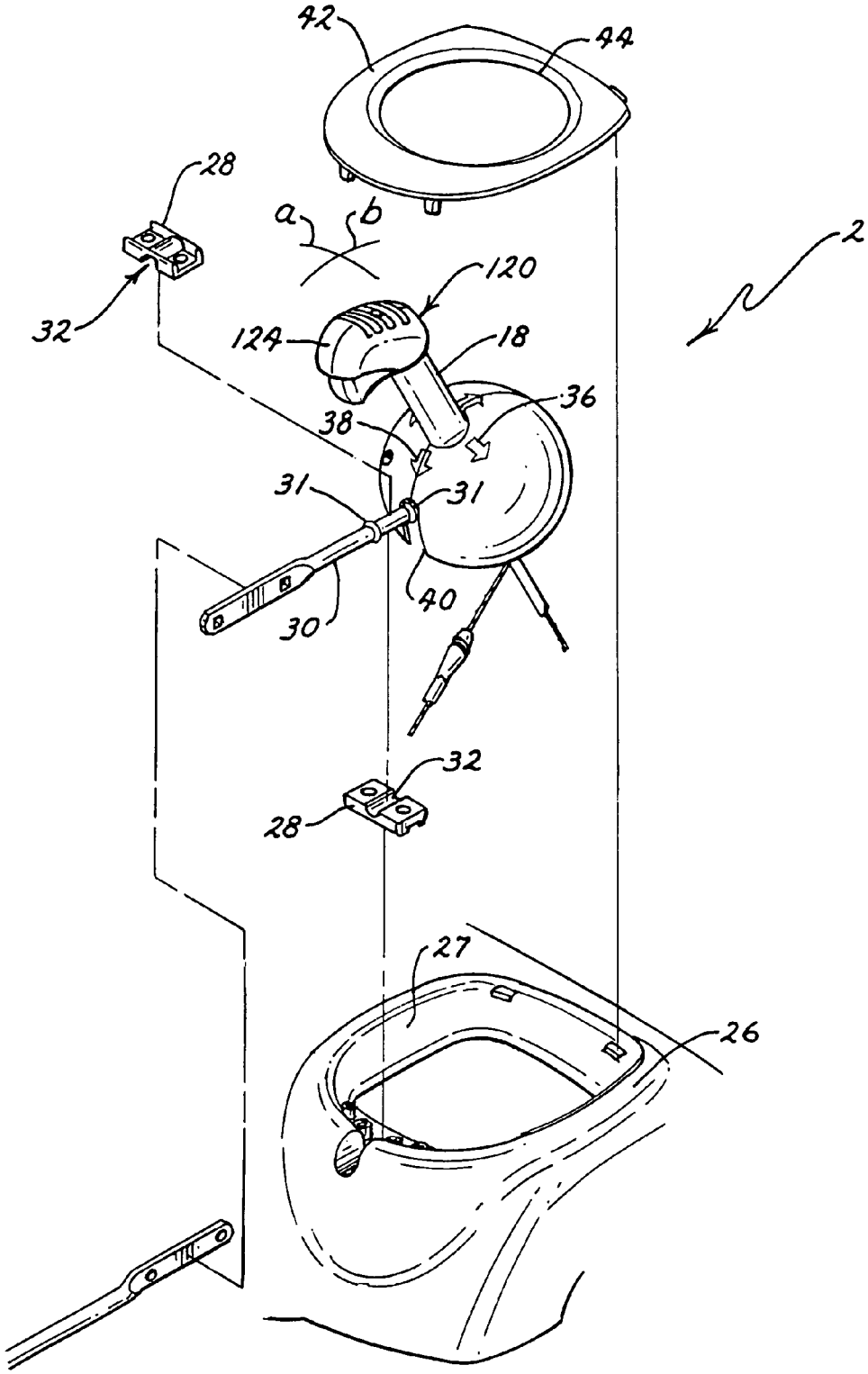
FIG. 5 is a perspective view of the single control handle shown in FIG. 4, particularly illustrating the control handle in an assembled form but with the assembled control handle being exploded from a mount on the snowthrower that carries or mounts the control handle on the snowthrower.

As shown in FIG. 5, control handle 18 is mounted for lateral pivoting in a mount 26 on the top of handle assembly 17 of snowthrower 4. Mount 26 includes an opening 27 in which the lower end of control handle 18 is received.

Control handle 18 is supported or carried in opening 27 of mount 26 by a pair of opposed top and bottom mounting plates 28. Mounting plates 28 are bolted or otherwise suitably secured to snowthrower 4 along the front edge of opening 27.

Mounting plates 28 are received on a cylindrical portion 30 of forwardly extending arm 22 of yoke 20 between two annular rings or shoulders 31 on arm 22. Each mounting plate 28 has a longitudinally extending, semicircular bore 32. Together, bores 32 form a longitudinal cylindrical socket in which cylindrical portion 30 of arm 22 is rotatably journalled.

Arm 22 of yoke 20 is supported between mounting plates 28 because shoulders 31 on arm 22 prevent arm 22 from sliding through mounting plates 28 when mounting plates 28 are assembled around arm 22. This carries or supports arm 22 of yoke 20, and thus yoke 20 and control handle 18 as well, on mount 26 of snowthrower 4. When control handle 18 is laterally pivoted in the direction of arrows A or B in FIG. 3, arm 22 of yoke 20 simply rotates within the cylindrical socket formed by bores 32 in mounting plates 28. Obviously, mounting plates 28 do not clamp against arm 22 with a force sufficient to prevent rotation of arm 22.

Referring to FIGS. 4 and 5, a spherical escutcheon 34 is formed from two semi-spherical escutcheon halves **34*r* and 34*l* that are bolted to one another around control handle 18. When so assembled, escutcheon will move with control handle 18. Escutcheon 34 does not mount or support control handle 18 in opening 27 as such support is provided only by the mounting plates 28 described earlier. Escutcheon 34 simply fills in part of the gap or space that would otherwise exist between control handle 18 and the sides of opening 27 in which control handle 18 is carried. Various lateral arrows 36 and longitudinal arrows 38 can be printed or formed on the top surface of escutcheon 34 to illustrate to the user the directions in which to move control handle 18**.

As shown in FIG. 5, a slot 40 is formed in the front of escutcheon 34 to permit the longitudinal pivoting of control handle 18. Without such a slot 40, arm 22 of yoke 20 would otherwise prevent longitudinal pivoting of control handle 18 as arm 22 would abut against the bottom edge of escutcheon 34 to prevent such pivoting. However, with slot 40, control handle 18 and escutcheon 34 can both pivot in the direction of arrows A and B since arm 22 will simply ride up or down in slot 40 as such pivoting takes place. A cover 42 having a circular opening 44 can be snapped into opening 27 to surround escutcheon 34 to take up the remaining gap or space between escutcheon 34 and the sides of opening 27.

Referring now to FIG. 3, a first mechanical linkage 46 couples control handle 18 to chute 6 for rotating chute 6 about vertical axis y when control handle 18 is laterally pivoted in the direction of arrows A and B. First mechanical linkage 46 includes a gear connection 48 to chute 6 that increases the amount of rotation provided in chute 6 for a given amount of pivoting of control handle 18. For example, lateral pivoting of control handle 18 to one side or the other of neutral by a given amount rotates chute 6 to the same side by a greater amount, e.g. by a factor of 2.6 to 1. This is desirable as it makes the task of adjusting chute 6 quicker and easier than in prior art snowthrowers.

As shown in FIGS. 7 and 8, gear connection 48 of first mechanical linkage 46 includes a drive gear 50 journalled for rotation in a longitudinal socket 52 of a support 54. Support 54 is fixed to snowthrower 4 on a mounting plate 56 carried at the upper end of a mounting arm 58. The purpose of mounting plate 56 and mounting arm 58 is to position support 54 vertically on snowthrower 4 at about the same level or height as the forwardly extending arm 22 on yoke 20.

As shown in FIG. 3, a connecting rod 60 connects drive gear 50 to arm 22 on yoke 20. Thus, as yoke 20 rotates about the axis of arm 22 due to lateral pivoting of control handle 18, connecting rod 60 will similarly rotate drive gear 50 within support 54. In other words, if yoke 20 rotates 15° due to a 15° lateral pivoting of control handle 18, drive gear 50 is also rotated 15° within socket 52 of support 54 by virtue of its connection to arm 22 through connecting rod 60.

Gear connection 48 also includes a smaller driven gear 62 fixed to a bracket 64 attached to the back of chute 6. Bracket 64 is vertically located at about the same level as mounting plate 56. A portion of bracket 64 overlies the front of mounting plate 56 to allow bracket 64 to be pivotally mounted on the front of mounting plate 56. A vertical pivot pin 66 passes through the overlying portion of bracket 64 and into the front of mounting plate 56.

The periphery of driven gear 62 is in engagement with drive gear 50 in a bevel type connection. As shown in FIG. 7, drive gear 50 is oriented perpendicularly to driven gear 62. Drive gear 50 is also much larger than driven gear 62. Accordingly, driven gear 62 has fewer teeth than the number of teeth on drive gear 50 which accounts for the increase in range of motion between chute 6 and control handle 18, i.e. 13 teeth on driven gear 62 and 34 teeth on drive gear 50.

A cover 68 is removably installed on the top of mounting plate 56 to enclose gear connection 48 between chute 6 and control handle 18. Cover 68 encloses drive gear 50 and driven gear 62 and overlies mounting plate 56 as shown in FIG. 2. Cover 68 may be bolted or screwed to support 54 that journals drive gear 50. In addition to aesthetically hiding gear connection 48, cover protects gear protection from the elements and helps prevent snow or ice from clogging gear connection 48.

When drive gear 50 is rotated about its axis, it acts on the periphery of driven gear 62 in an attempt to rotate the same. However, driven gear 62 is not rotatable on bracket 64 carried on chute 6, but is fixed thereon by screws or bolts 70. Bracket 64 is itself rotatable on mounting plate 56 for drive gear 50 by the aforementioned pivot pin 66. Thus, the torque exerted on driven gear 62 is transmitted to bracket 64 to thereby rotate chute 6 about the rotatable connection of chute 6 to snowthrower 4. Accordingly, when drive gear 50 acts on driven gear 62, the result is to laterally pivot chute 6 about vertical axis y to adjust where the snow stream being delivered by chute 6 is directed.

A second mechanical linkage 72 couples control handle 18 to deflector 14 for pivoting deflector 14 about horizontal axis x as control handle 18 is longitudinally pivoted in the direction of arrows C and D. As shown in FIG. 4, second mechanical linkage 72 is a flexible linkage comprising an inner cable 74 contained within an outer sheath 76. Such cable linkages 72 are well known in outdoor power equipment units such as lawn mowers or snowthrowers. When outer sheath 76 is fixed to snowthrower 4, inner cable 74 may be pulled back and forth inside outer sheath 76 to activate a desired component.

In this particular invention, outer sheath 76 of cable linkage 72 has its front end fixed or anchored to bracket 64 on chute 6. Bracket 64 has a laterally extending tab 78 to which outer sheath 76 may be suitably affixed or clamped to fix the front end of outer sheath 76 to bracket 64. See FIGS. 7–9. The rear end of outer sheath 76 is fixed to a similar tab 80 on yoke 20. The rear end of outer sheath 76 includes an annular groove 82 that is received in a slot on tab 80 of yoke 20 to affix the rear end of outer sheath 76 to yoke 20. See FIGS. 4 and 6.

The front and rear ends of inner cable 74 contained within outer sheath 76 are fixed to deflector 14 and control handle 18, respectively. For example, referring to FIGS. 4 and 6 again, the rear end 84 of inner cable 74 is hooked in a hole 86 on a rearwardly extending portion of control handle 18. Referring to FIG. 8, the front end of inner cable 74 is similarly hooked or secured to a forwardly extending offset end 88 of a pivot shaft 90. Pivot shaft 90 is fixed to deflector 14, lies along horizontal axis x, and is pivotably journaled on top of chute 6 to pivotably mount deflector 14 to the top of chute 6.

A torsion spring 92 surrounds pivot shaft 90 and biases deflector 14 into its most elevated position. This is shown in solid lines in FIG. 8. In this position, inner cable 74 has been pulled forwardly relative to outer sheath 76 by a maximum amount by the bias of spring 92. This position of deflector 14 also corresponds to the position of control handle 18 in which control handle 18 is in its most rearward position with reference to movement of control handle 18 along longitudinal axis b.

If the user wishes to lower the elevation of deflector 14 to lower the trajectory of the snow stream being thrown by chute 6, the user need only move control handle 18 more forwardly about its pivotal connection to yoke 20. This will cause the rear end of inner cable 74 to be pulled upwardly and rearwardly as indicated by the arrow F in FIG. 6 thereby retracting the front end of inner cable 74 as indicated by the arrow G in FIG. 8. This retraction of inner cable 74 acts on the offset end 88 of pivot shaft 90 to pivot the entire deflector 14 downwardly relative to the top of chute 6. A locking mechanism will hold deflector 14 in an adjusted position as will be described hereafter.

The basic operation of chute 6 and deflector 14 should be apparent to those skilled in the art. If the user wishes to rotate chute 6 about vertical axis y, the user need only pivot control handle 18 laterally in the desired direction to effect such rotation. Pivoting control handle 18 to the right swings chute 6 to the right and vise versa. Purely lateral pivoting of control handle 18 has no effect on deflector 14.

If the user wishes to pivot deflector 14 on the top of chute 6 about horizontal axis x, the user need only pivot control handle 18 longitudinally to effect such pivoting. Pushing forward on control handle 18 lowers the trajectory of the snow stream by lowering deflector 14. Conversely, pulling back on control handle 18 raises the trajectory of the snow stream by raising deflector 14. Purely longitudinal pivoting of control handle 18 has no effect on chute 6.

Obviously, if the user pivots control handle 18 both laterally and longitudinally at the same time, both chute 6 and deflector 14 will be simultaneously adjusted. For example, if the user pivots control handle 18 to the right while pushing control handle 18 forwardly as well, chute 6 will swing to the right and deflector 14 will lower at the same time.

In this invention, a single conveniently located control handle 18 both rotates chute 6 and pivots deflector 14, which is an advantage over many conventional snowthrowers having multiple controls for doing the same thing. Another advantage of control 2 of this invention is the fact that simple mechanical linkages connect control handle 18 to chute 6 and deflector 14 for operating the same. Thus, a snowthrower equipped with control 2 of this invention is considerably simpler, less expensive and more durable than snowthrowers which use independent electric motors to rotate chute 6 and deflector 14 from a joystick control handle.

A locking mechanism 94 is desirably used to retain both chute 6 and deflector 14 in their adjusted positions. Without such a locking mechanism 94, the positions of chute 6 and deflector 14 could inadvertently drift or move during operation of snowthrower 4, either from the force of the snow or engine vibration. In addition, providing a locking mechanism 94 for deflector 14 does away with the need for the user to continually hold control handle 18 in a desired longitudinally adjusted position to maintain a desired adjusted position for deflector 14. Without some type of lock, the biasing provided by spring 92 and the force of the snow acting on deflector 14 would tend to return deflector 14 to its position of maximum elevation once the user released control handle 18.

Figure 6:
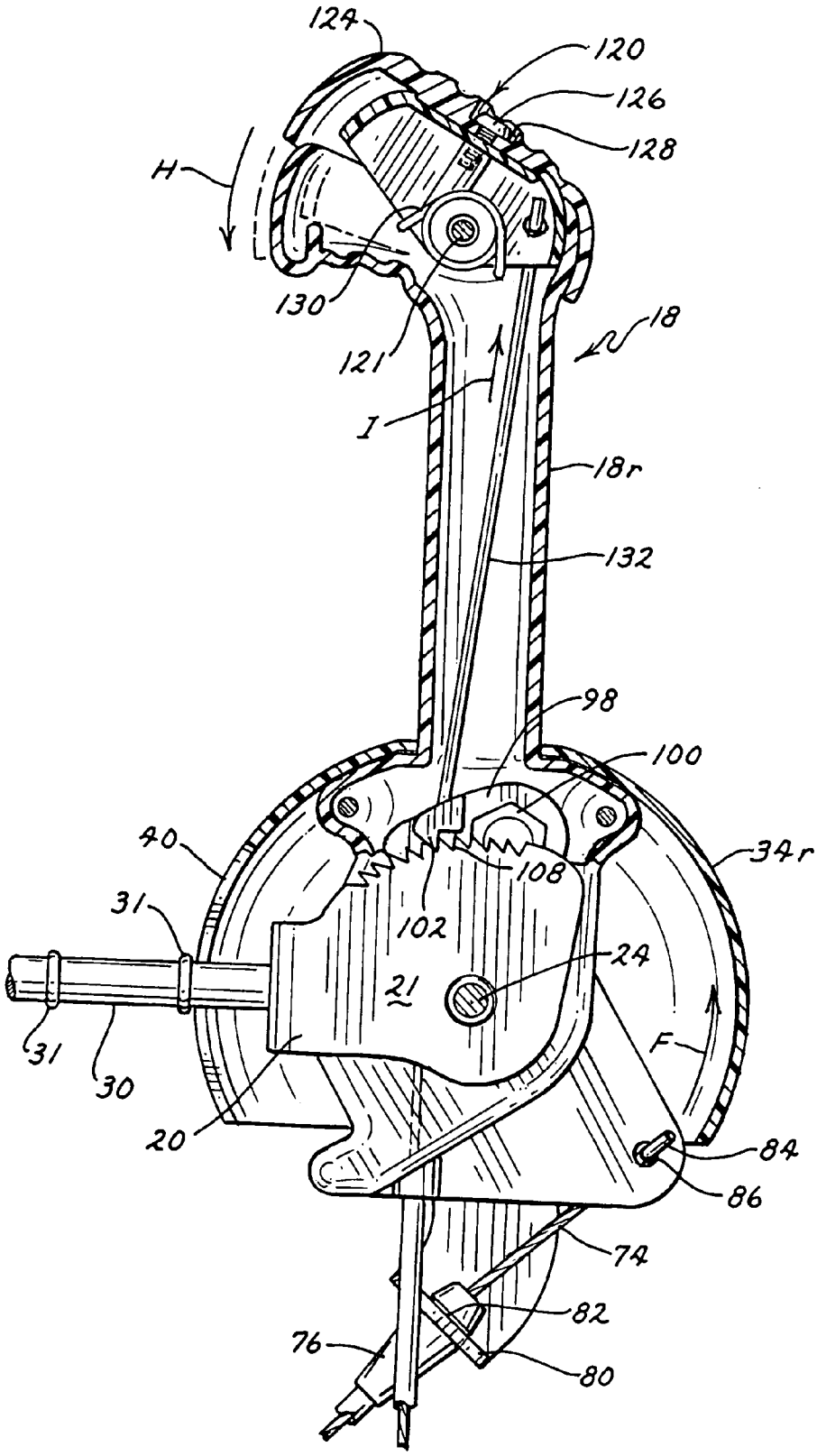
FIG. 6 is a cross-sectional view through the control handle shown in FIG. 4.

In any event and referring first to FIG. 4, locking mechanism 94 includes a pivotal locking member 96. Locking member 96 is pivotally journalled in the interior of control handle 18 between control handle halves **18*r* and 18*l*. A first latch 98 is non-rotatably fixed to locking member 96 to pivot therewith. First latch 98 is non-rotatably received on a hex shaped hub 100 of locking member 96. First latch 98 has a downwardly directed locking tooth 102 that is carried on a laterally directed arm 104 of latch 98. The laterally directed arm 104 of latch 98 sticks through a slot 106 in the left control handle half 18*l* to position locking tooth 102 outside of control handle 18. Locking tooth 102 is located directly above a set of serrated teeth 108 provided on one of the legs 21 of yoke 20. Engagement between locking tooth 102 on first latch 98 and teeth 108 on yoke 20 locks control handle 18 relative to yoke 20 to prevent longitudinal pivoting of control handle 18 relative to yoke 20. FIG. 6 illustrates locking tooth 102 in locking engagement with teeth 108**.

Locking tooth 102 and teeth 108 are shaped to prevent rearward longitudinal pivoting of control handle 18 to prevent the force of the snow acting on deflector 14 from raising deflector 14. Locking tooth 102 and teeth 108 are not shaped to prevent forward longitudinal pivoting of control handle 18 as tooth 102 would ratchet over teeth 108. However, control handle 18 need not be locked against movement in this direction since the force of the snow on deflector 14 never attempts to move control handle 18 forwardly. However, locking tooth 102 and teeth 108 could be shaped to lock control handle 18 against movement in both directions if so desired.

Figure 9:
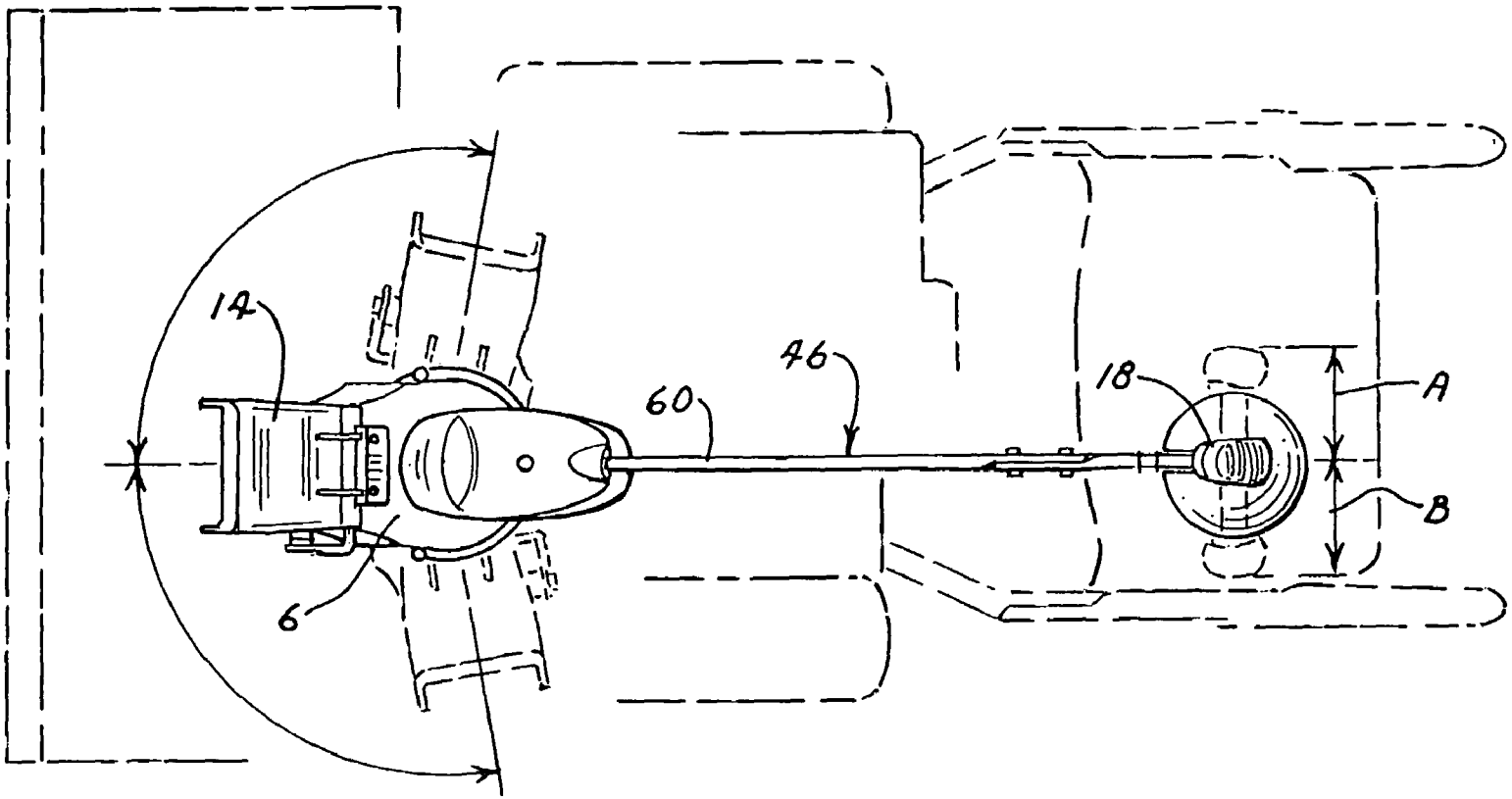
FIG. 9 is a top plan view of the chute adjusting structure shown in FIG. 7.

Locking mechanism 94 includes a second latch 110 to prevent lateral pivoting of yoke 20 about the pivot axis formed by the cylindrical portion 30 of arm 22 on yoke 20. Referring now to FIGS. 7–9, second latch 110 is pivotally carried on mounting plate 56 by a pivot pin 112. Latch 110 includes one or more locking teeth 114 biased by a torsion spring 116 (see FIG. 7) into engagement with the outer periphery of a locking gear 118 that is fixed to driven gear 62. When latch 110 is engaged with the periphery of locking gear 118 as shown in FIG. 9, gear connection 48 between drive gear 50 and driven gear 62 is locked and cannot rotate, thus locking or maintaining the lateral adjusted position of control handle 18 and chute 6.

Control handle 18 includes a manual release 120 for unlatching first and second latches 98 and 110 to allow the position of control handle 18 to be adjusted along either or both of the axes a and b. Release 120 is pivotally carried on the top of control handle 18 for rotation about a horizontal pivot axis 121. Referring to FIGS. 4 and 6, release 120 includes a bottom part 122 contained within control handle 18 and a top part 124 that overlies the top of control handle 18. Bottom part 122 of release 120 is pivotally journalled within the top of control handle 18. Bottom and top parts 122 and 124 of release 120 are secured together by a screw 126 to rotate as a single unit about pivot axis 121.

Top part 124 of release 120 is larger than the top of control handle 18 and completely overlies the top of control handle 18. Top part 124 of release is shaped as a hollow shell having an open bottom such that the top part 124 of release 120 nests or extends somewhat over the top of control handle 18. See FIG. 6. The user grabs the top of control handle 18 by grabbing the top part 124 of release 120. Top part 124 of release 120 preferably includes a plurality of lateral serrations or ribs 128 to form a roughened grip surface for engagement by the user's hand.

When the user grabs the top of control handle 18 with one hand to operate the same, the user's palm will hit top part 124 of release 120 and depress top part 124 of release 120 by pivoting top part 124 in a clockwise direction about pivot axis 121 as indicated by the arrow H in FIG. 6. A torsion spring 130 opposes this motion with torsion spring 130 normally keeping top part 124 of release 120 extended up above the top of control handle 18 as shown in FIG. 6. However, once the user engages control handle 18 with one hand with the user's palm facing downwardly as it normally would when the user puts his hand down on top of control handle 18, the user's palm will inevitably depress top part 124 of release 120 as described above. Rotation of top part 124 of release 120 also rotates bottom part 122 of release 120 since the two are fixed together by screw 126.

A connecting link 132 extends between bottom part 122 of release 120 and pivotal locking member 96 in control handle 18. As bottom part 122 of release 120 pivots in the counter-clockwise direction H, connecting link 132 is raised in the direction of the arrow I in FIG. 6. The lower end of connecting link 132 is connected to pivotal locking member 96 forwardly of the pivot axis of pivotal locking member 96. This causes pivotal locking member 96 to rotate about its pivot axis in a clockwise direction.

As pivotal locking member 96 pivots in a clockwise direction, it acts on both latches 98 and 110 to simultaneously unlatch both latches. First latch 98 simply pivots with locking member 96 as it is non-rotatably carried thereon to disengage locking tooth 102 from teeth 108 on yoke 20. Second latch 110 is connected to pivotal locking member 96 by a second cable type flexible linkage 134 having an inner cable 136. Thus, the clockwise pivoting motion of pivotal locking member 96 pulls up on the rear end of cable 136 to retract cable 136 within its outer sheath 138. This retraction of cable 136 as depicted by the arrow J in FIG. 9 pivots latch 110 in a counter-clockwise direction in FIG. 9 to remove locking teeth 114 from engagement with locking gear 118. Unlatching first latch 98 frees control handle 18 for longitudinal pivoting while unlatching second latch 110 frees control handle 18 for lateral pivoting.

Accordingly, the mere act of gripping the top of control handle 18 with one hand automatically unlatches both first and second latches 98 and 110 by automatically depressing release 120 with the palm of the hand being used to grip control handle 18. The user can then pivot control handle 18, either laterally or longitudinally or both, to position chute 6 and deflector 14 in desired orientations. If the user then releases control handle 18, release 120 will be biased by torsion spring 130 and spring 116 back into its extended, uppermost and locked position. In this position, both latches 98 and 110 have relocked to hold chute 6 and deflector 14 in their adjusted positions until such time as the user grips control handle 18 again to further reposition chute 6 and/or deflector 14.

Use of some type of locking mechanism, such as locking mechanism 94, is preferred for holding chute 6 and deflector 14 in place. However, such a locking mechanism 94 could be dispensed. For example, if there is sufficient friction in gear connection 48 between chute 6 and control handle 18 and between deflector 14 and the top of chute 6, chute 6 and deflector 14 could conceivably hold their adjusted positions without using latches. However, such friction increases the force required from the user to move control handle 18 to reposition chute 6 and deflector 14. Accordingly, it is preferred that the system be relatively friction free to be easy to adjust and that a locking mechanism of some type be used to hold the parts in their adjusted positions without drifting during operation of the snowthrower.

Locking mechanisms other than that shown herein could be used. Different mechanical linkages could be used to couple chute 6 and deflector 14 to control handle 18. Various other modifications of this invention will be apparent to those skilled in the art. Accordingly, this invention is to be limited only by the appended claims.

We claim:

1. An improved snowthrower of the type having a chute rotatable about a substantially vertical axis for directing a snow stream laterally with respect to the snowthrower, a deflector carried on the chute with the deflector being pivotal about a substantially horizontal axis for adjusting the trajectory of the snow stream, and a control on the snowthrower for operating the chute and the deflector, wherein the improvement relates to the control which comprises;

(a) a single control handle carried on the snowthrower for motion along first and second axes;

(b) a first mechanical, non-motorized linkage coupling the chute to the control handle such that movement of the control handle along the first axis rotates the chute about the substantially vertical axis;

(c) a second mechanical, non-motorized linkage coupling the deflector to the control handle such that movement of the control handle along the second axis pivots the deflector on the chute about the substantially horizontal axis; and (d) a locking mechanism for holding the chute and deflector in adjusted positions, wherein the locking mechanism includes a first latch for holding the chute in an adjusted position and a second latch for holding the deflector in an adjusted position.

2. The snowthrower of claim 1, wherein the first axis is a lateral axis on the snowthrower.

3. The snowthrower of claim 2, wherein the second axis is a longitudinal axis on the snowthrower.

4. The snowthrower of claim 1, wherein the first mechanical linkage includes a gear connection between the chute and the control handle.

5. The snowthrower of claim 4, wherein the gear connection is configured to rotate the chute by an angular amount greater than the movement of the control handle along the first axis.

6. The snowthrower of claim 5, wherein the gear connection includes a drive gear engaging a driven gear, the drive gear being larger than the driven gear and having more teeth than the driven gear.

7. The snowthrower of claim 1, wherein the second mechanical linkage comprise a flexible cable linkage.

8. The snowthrower of claim 7, wherein the flexible cable linkage comprises a cable contained inside an outer sheath.

9. The snowthrower of claim 1, wherein both the first and second latches are biased into locked positions.

10. The snowthrower of claim 1, further including a common release for releasing both latches.

11. The snowthrower of claim 10, wherein the common release is located at the top of the control handle for engagement by the user.

12. The snowthrower of claim 11, wherein the common release is spring biased into a raised or elevated position on the top of the control handle, wherein the release member is configured to be engaged by a palm of one hand of the user as the user's one hand grips the control handle to be depressed when the user grips the control handle with the user's one hand.

13. The snowthrower of claim 1, wherein the control handle has pivotal motion along the first and second axes.

14. An improved snowthrower of the type having a chute rotatable about a substantially vertical axis for directing a snow stream, a deflector carried on the chute for pivoting about a substantially horizontal axis for adjusting the trajectory of the snow stream, and a control on the snowthrower for operating the chute and the deflector, wherein the improvement relates to the control which comprises:

(a) a single control handle carried on the snowthrower for lateral motion and longitudinal motion;

(b) a rotatable arm having an axis which arm is attached to the control handle, wherein the arm is free to rotate on the snowthrower about the axis of the arm as the control handle is moved laterally, the arm being mechanically attached to a drive gear operatively connected to the chute such that lateral motion of the control handle is directly transmitted to and rotates the arm to rotate the drive gear to thereby rotate the chute about the substantially vertical axis; and (c) a flexible cable extending between and interconnecting the control handle and the deflector such that longitudinal motion of the control handle directly retracts the cable to pull on the deflector to pivot the deflector about the substantially horizontal axis.

15. The snowthrower of claim 14, further including a latch for preventing the drive gear from rotating to lock the control handle against lateral motion.

16. The snowthrower of claim 15, wherein the latch pivots between locked and unlocked positions with the latch being spring biased into a locked position.

17. The snowthrower of claim 15, further including a manually operated release on the control handle for unlocking the latch to permit rotation of the drive gear and adjustment of the chute.

18. The snowthrower of claim 15, further including another latch for preventing the control handle from moving longitudinally in at least one direction.

19. An improved snowthrower of the type having a chute rotatable about a substantially vertical axis for directing a snow stream, a deflector carried on the chute for pivoting about a substantially horizontal axis for adjusting the trajectory of the snow stream, and a control on the snowthrower for operating at least one of the chute and the deflector, wherein the improvement relates to the control which comprises:

(a) a control handle carried on the snowthrower (b) a first mechanical linkage coupling the control handle to at least a first component from a group of components comprising the chute and the deflector such that movement of the control handle along a first axis mechanically moves the first component;

(c) a positive latch for maintaining the first component in an adjusted position during operation of the snowthrower; and (d) a latch release movably carried on the control handle and operatively connected to the positive latch for releasing the positive latch when the latch release is actuated by a user by selectively and seperately moving the latch release relative to the the control handle.

20. The snowthrower of claim 19, wherein the first component comprises the chute.

21. The snowthrower of claim 20, wherein the first mechanical linkage comprises a gear connection between the chute and the control handle, and wherein the gear connection is configured to rotate the chute by an angular amount greater than the movement of the control handle along the first axis.

22. The snowthrower of claim 19, wherein the first component comprises the deflector.

23. The snowthrower of claim 19, further including a second mechanical linkage coupling the control handle to at least a second component from a group of components comprising the chute and the deflector such that movement of the control handle along a second axis mechanically moves the second component, further including a second positive latch for maintaining the second component in an adjusted position during operation of the snowthrower, and wherein the latch release is also operatively connected to the second positive latch for also releasing the second positive latch when the latch release is actuated by the user.

24. The snowthrower of claim 23, wherein the first component comprises the chute and the second component comprises the deflector.

25. The snowthrower of claim 19, wherein the latch release is pivotally carried on the control handle.

26. The snowthrower of claim 19, wherein the latch release is biased by a spring relative to the control handle such that the latch release normally projects outwardly from the control handle the latch release being actuated by the user by compressing the latch release towards the control handle.

27. The snowthrower of claim 26, wherein the latch release is carried on an upper end of the control handle.

28. The snowthrower of claim 27, wherein the latch release is carried on top of the control handle and is compressed towards the control handle by being depressed downwardly towards the control handle by the user.

29. The snowthrower of claim 28, wherein the latch release is positioned on the control handle to be depressed downwardly towards the control handle by a palm of one hand of the user as the user's one hand grips the control handle.

30. The snowthrower of claim 26, wherein the latch release is pivotally carried on the control handle.

31. An improved snowthrower of the type having an upwardly and rearwardly extending handle assembly for allowing a user to walk behind the snowthrower, a chute rotatable about a substantially vertical axis for directing a snow stream, a deflector carried on the chute for pivoting about a substantially horizontal axis for adjusting the trajectory of the snow stream, and a control on the snowthrower for operating the chute, wherein the improvement relates to the control which comprises:

(a) a control handle carried on the handle assembly of the snowthrower with the control handle spaced rearwardly from the chute;

(b) a mechanical linkage extending between the control handle and the chute and coupling the control handle to the chute such that lateral back and forth movement of the control handle along a lateral axis on the handle assembly mechanically rotates the chute in opposed directions about the vertical axis; and (c) a positive latch for maintaining the chute in an adjusted position during operation of the snowthrower.

32. An improved snowthrower of the type having a chute rotatable about a substantially vertical axis for directing a snow stream laterally with respect to the snowthrower, a deflector carried on the chute with the deflector being pivotal about a substantially horizontal axis for adjusting the trajectory of the snow stream, and a control on the snowthrower for operating the chute and the deflector, wherein the improvement relates to the control which comprises:

(a) a single control handle carried on the snowthrower for motion along first and second axes that are spaced apart from the substantially vertical and horizontal axes of the chute and the deflector, respectively, the control handle being manually movable by an operator;

(b) a first mechanical linkage coupling the chute to the control handle such that movement of the control handle along the first axis rotates the chute about the substantially vertical axis by transmitting to the chute whatever force is applied to the control handle by the operator directed along the first axis; and (c) a second mechanical indicate coupling the deflector to the control handle such that movement of the control handle along the second axis pivots the deflector on the chute about the substantially horizontal axis by transmitting to the deflector whatever force is applied to the control handle by the operator directed along the second axis.

33. The snowthrower of claim 32, wherein the control handle has pivotal motion along the first and second axes.

34. The snowthrower of claim 32, wherein the control handle is carried on a handle assembly of the snowthrower.

35. The snowthrower of claim 32, wherein the first axis is a lateral axis on the snowthrower.

36. The snowthrower of claim 35, wherein the second axis is a longitudinal axis on the snowthrower.

* * * * *

UNITED STATES PATENT AND TRADEMARK OFFICE

CERTIFICATE OF CORRECTION

PATENT NO. : 7,032,333 B2
APPLICATION NO. : 10/464434
DATED : April 25, 2006
INVENTOR(S) : Nathan J. Friberg et al.

It is certified that error appears in the above-identified patent and that said Letters Patent is hereby corrected as shown below:

Col. 14, Line 5, change "a second mechanical indicate" to --a second mechanical linkage--.

Signed and Sealed this

Fourth Day of July, 2006

JON W. DUDAS
*Director of the United States Patent and Trademark Office*